US010822057B1

(12) United States Patent
Mendes

(10) Patent No.: US 10,822,057 B1
(45) Date of Patent: Nov. 3, 2020

(54) ANCHOR-RETRIEVING SYSTEM

(71) Applicant: Joe Mendes, Holmdel, NJ (US)

(72) Inventor: Joe Mendes, Holmdel, NJ (US)

( * ) Notice: Subject to any disclaimer, the term of this patent is extended or adjusted under 35 U.S.C. 154(b) by 0 days.

(21) Appl. No.: 16/443,981

(22) Filed: Jun. 18, 2019

(51) Int. Cl.
*B63B 21/46* (2006.01)
*B63B 21/32* (2006.01)
*B63B 21/24* (2006.01)

(52) U.S. Cl.
CPC ..... *B63B 21/46* (2013.01); *B63B 21/32* (2013.01); *B63B 2021/246* (2013.01)

(58) Field of Classification Search
CPC ... B63B 21/24; B63B 2021/246; B63B 21/26; B63B 21/262; B63B 21/30; B63B 21/32; B63B 21/38; B63B 21/40; B63B 21/42; B63B 21/46; B63B 21/50; B63B 21/58; B63B 21/60; B63B 21/66; B63B 2021/666
USPC ..... 114/210, 293, 294, 295, 297, 299, 301, 114/303, 304, 310
See application file for complete search history.

(56) References Cited

U.S. PATENT DOCUMENTS 2,816,522 A * 12/1957 Root ..... B63B 21/46 114/299
2,980,050 A * 4/1961 Murray ..... B63B 21/243 114/298
3,030,907 A * 4/1962 Rosselle ..... B63B 21/46 114/299
3,150,629 A * 9/1964 Hardy ..... B63B 21/22 114/299
3,995,577 A 12/1976 Gentry
4,067,282 A * 1/1978 Guinn ..... B63B 21/22 114/230.2
4,836,126 A 6/1989 Kobayashi
5,074,235 A 12/1991 Kobayashi
5,784,981 A * 7/1998 Graham, Sr. ..... B63B 21/46 114/299
6,311,636 B1 11/2001 degenkamp
7,886,681 B2 * 2/2011 Weinstein ..... B63B 21/46 114/299
8,485,117 B2 7/2013 Weinstein
8,752,497 B2 6/2014 Crippa
2009/0266287 A1 10/2009 Neidemair

* cited by examiner

*Primary Examiner* — Daniel V Venne
(74) *Attorney, Agent, or Firm* — Kyle A. Fletcher, Esq.

(57) ABSTRACT

The anchor-retrieving system comprises a recovery harness and a lap link. The recovery harness may couple to an anchor via the lap link such that if the anchor becomes fouled the lap link may fail and a trip line of the recovery harness may be operable to recover the anchor by pulling the anchor from a crown of the anchor. The recovery harness may comprise three loops. A first loop may couple to the head of the anchor via the lap link. A second loop, adjacent to the first loop, may couple to an anchor line via rode hardware. The third loop, separated from the others via a trip line that is longer than the shank of the anchor may couple to an aperture in the crown of the anchor.

17 Claims, 5 Drawing Sheets

ANCHOR-RETRIEVING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of boating equipment, more specifically, an anchor-retrieving system.

SUMMARY OF INVENTION

The anchor-retrieving system comprises a recovery harness and a lap link. The recovery harness may couple to an anchor via the lap link such that if the anchor becomes fouled the lap link may fail and a trip line of the recovery harness may be operable to recover the anchor by pulling the anchor from a crown of the anchor. The recovery harness may comprise three loops. A first loop may couple to the head of the anchor via the lap link. A second loop, adjacent to the first loop, may couple to an anchor line via rode hardware. The third loop, separate from the others via a trip line that is longer than the shank of the anchor may couple to an aperture in the crown of the anchor.

An object of the invention is to retrieve a stuck anchor.

Another object of the invention is to apply an anchor weighing force to the head of the anchor via a lap link.

A further object of the invention is to provide a lap link that will break at a predefined force threshold.

Yet another object of the invention is to provide a trip line of the recovery harness coupled to a crown of the anchor to retrieve the anchor after the lap link breaks.

These together with additional objects, features and advantages of the anchor-retrieving system will be readily apparent to those of ordinary skill in the art upon reading the following detailed description of the presently preferred, but nonetheless illustrative, embodiments when taken in conjunction with the accompanying drawings.

In this respect, before explaining the current embodiments of the anchor-retrieving system in detail, it is to be understood that the anchor-retrieving system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the anchor-retrieving system.

It is therefore important that the claims be regarded as including such equivalent construction insofar as they do not depart from the spirit and scope of the anchor-retrieving system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
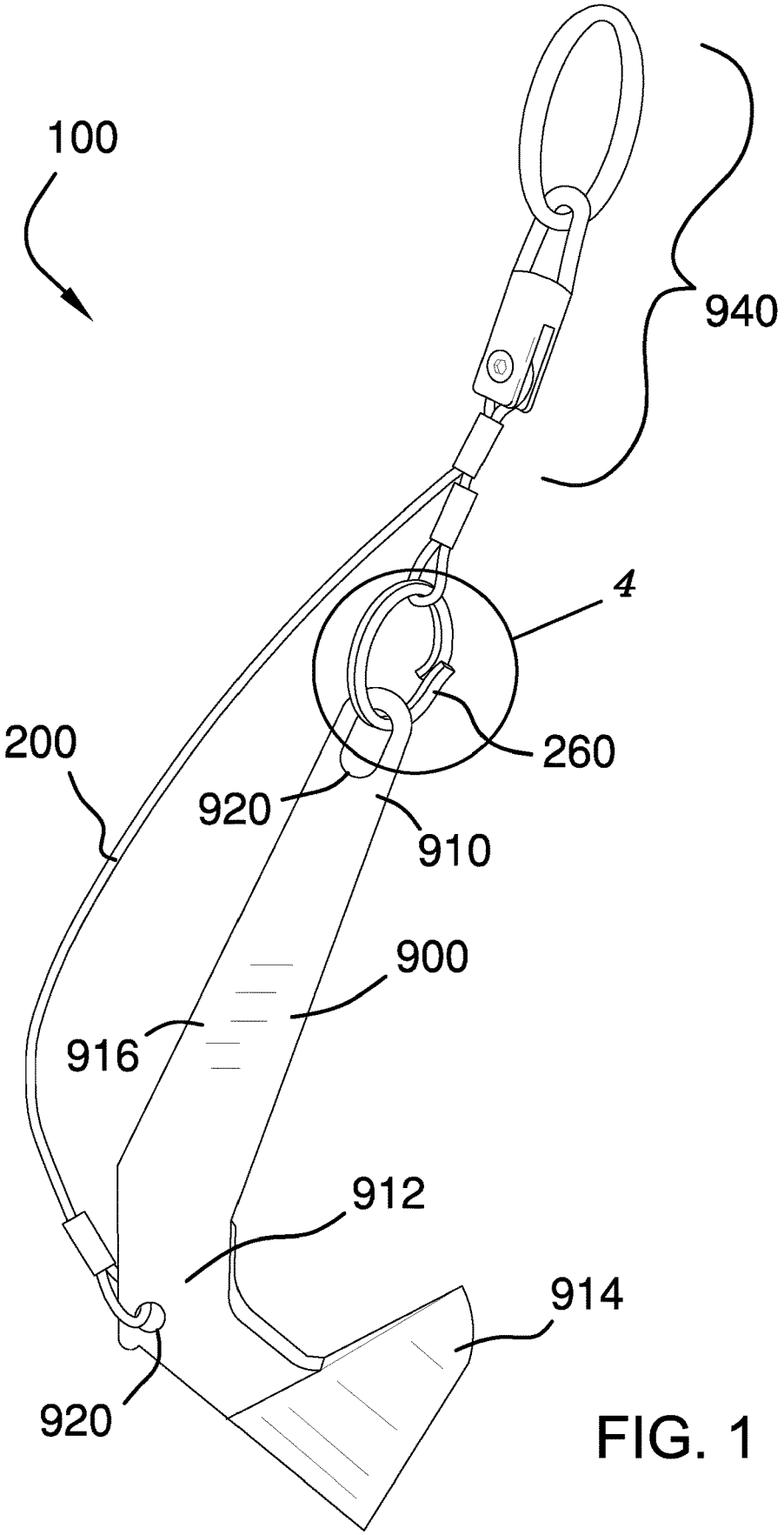
FIG. 1 is a side view of an embodiment of the disclosure illustrating the recovery harness and lap link coupled to an anchor and rode hardware.
Figure 2:
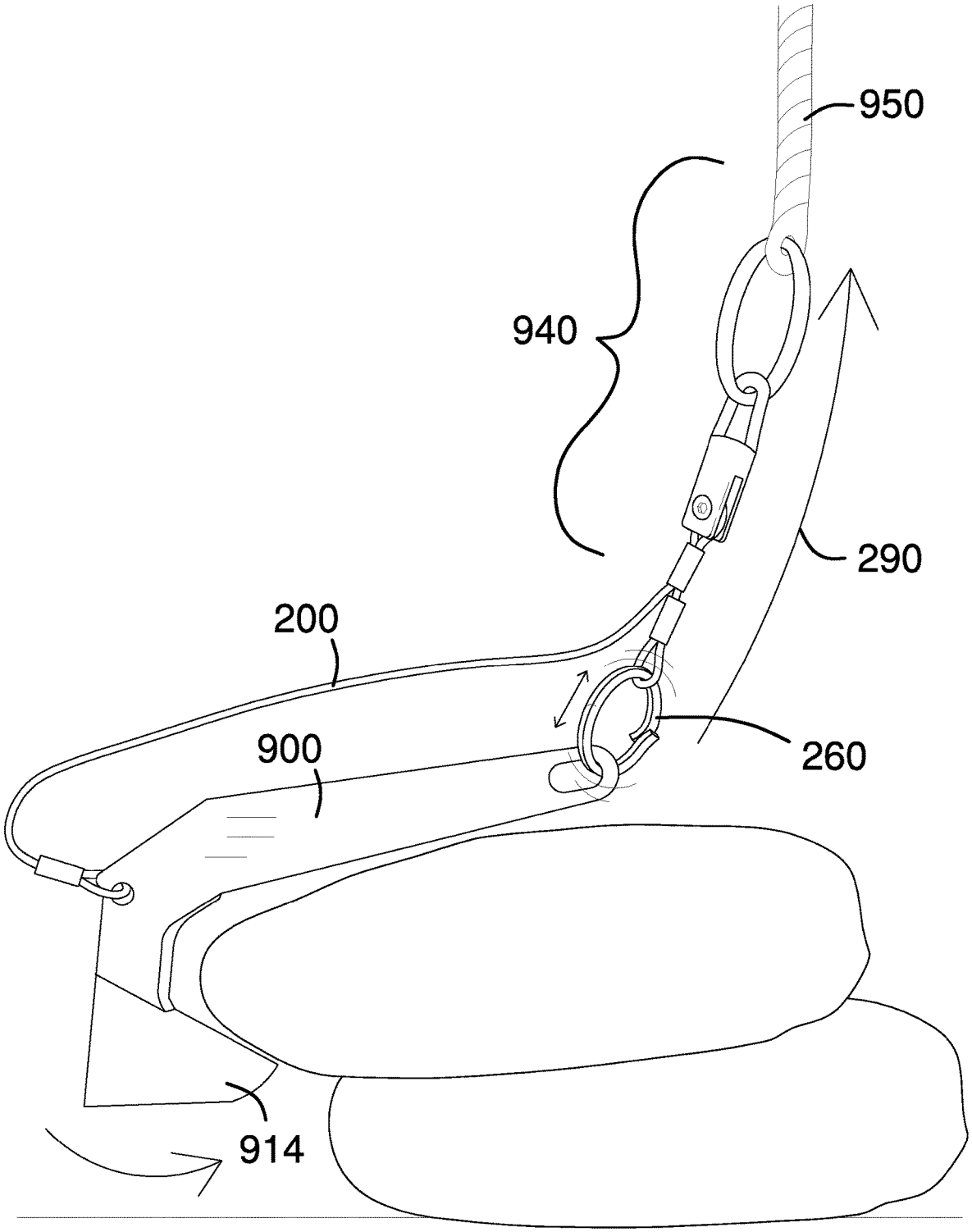
FIG. 2 is an in-use view of an embodiment of the disclosure illustrating an anchor snagged on a rock while being weighed.
Figure 3:
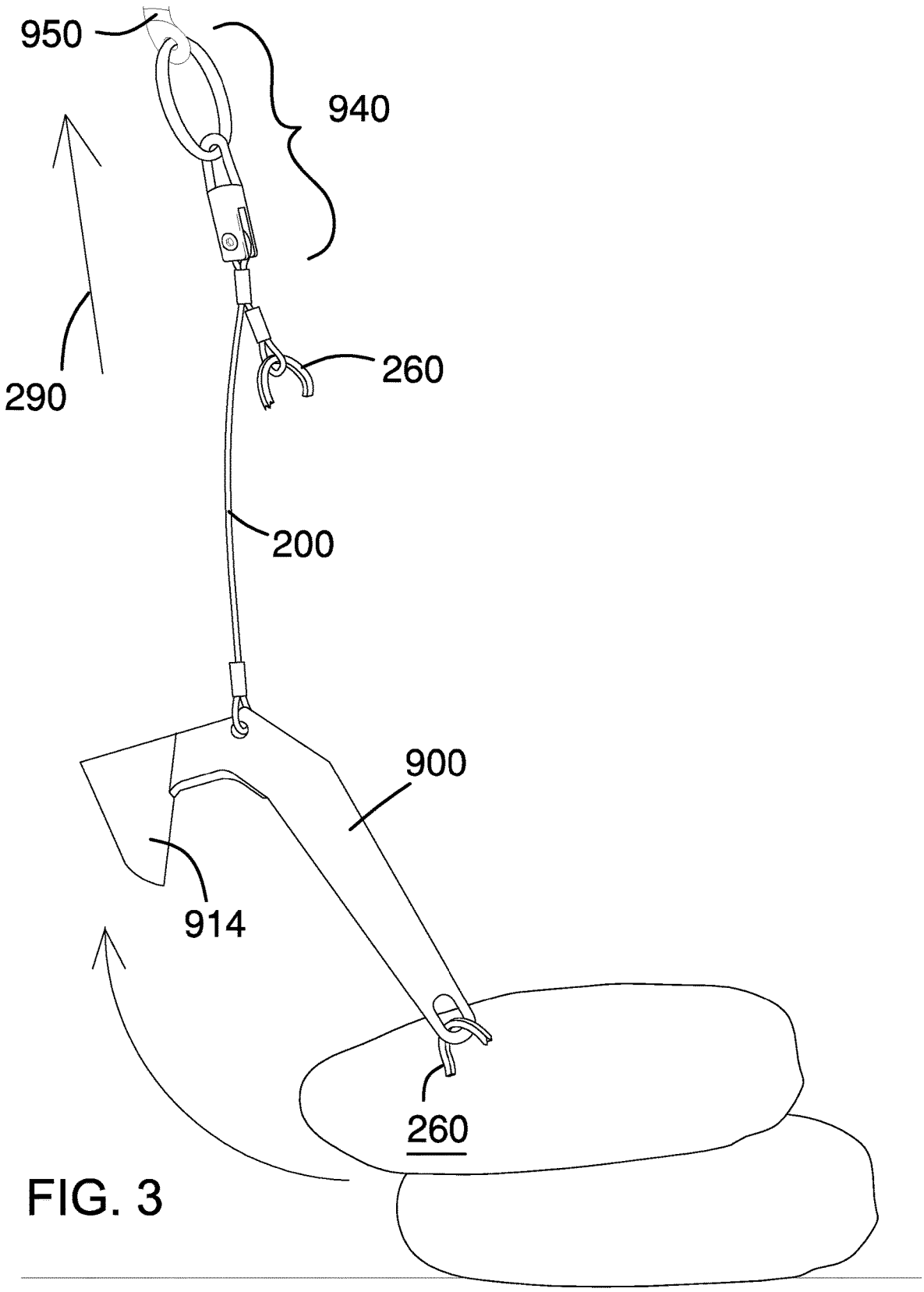
FIG. 3 is an in-use view of an embodiment of the disclosure illustrating the anchor being retrieved by the trip line of the recovery harness after the lap link has broken.
Figure 4:
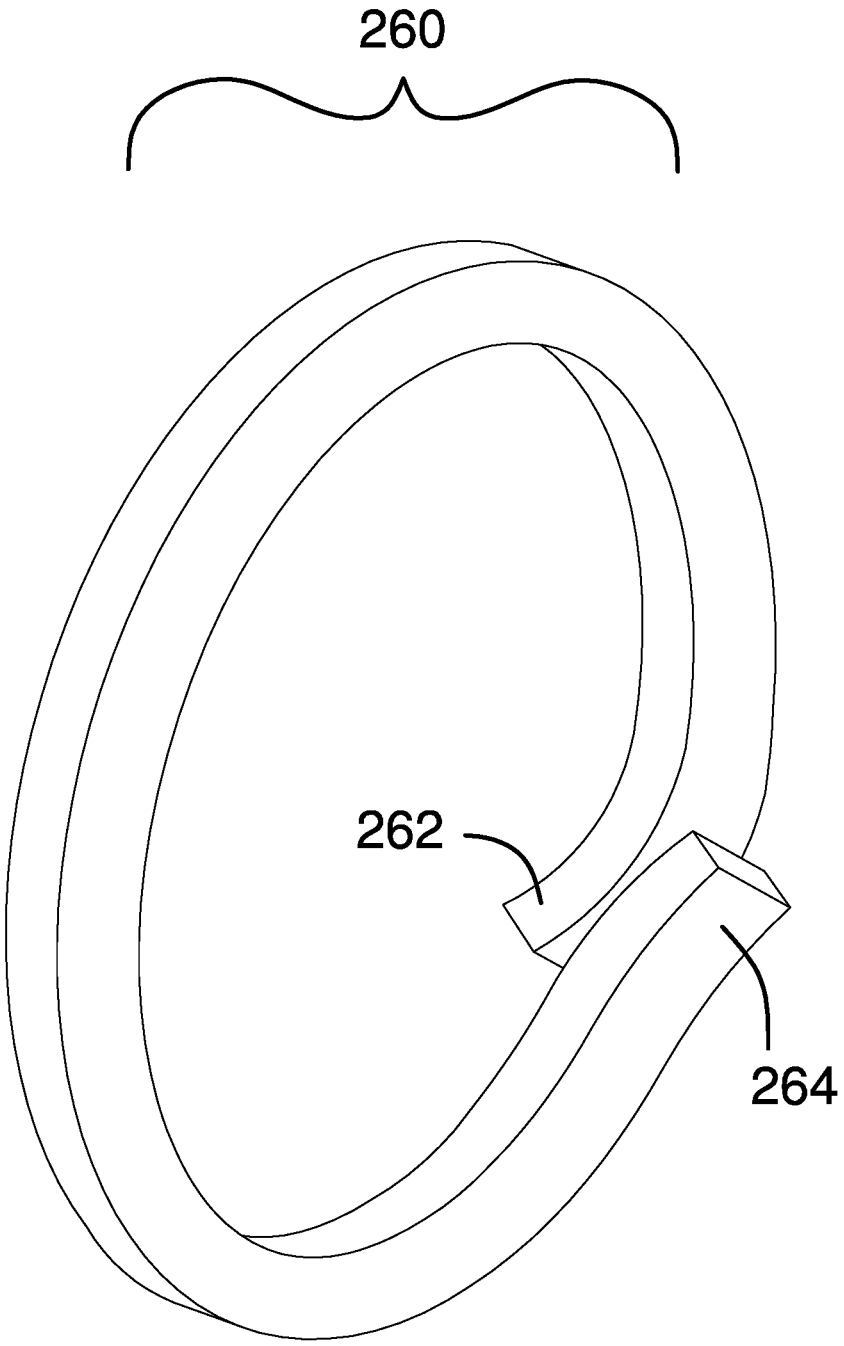
FIG. 4 is a detail view of an embodiment of the disclosure illustrating the lap link.
Figure 5:
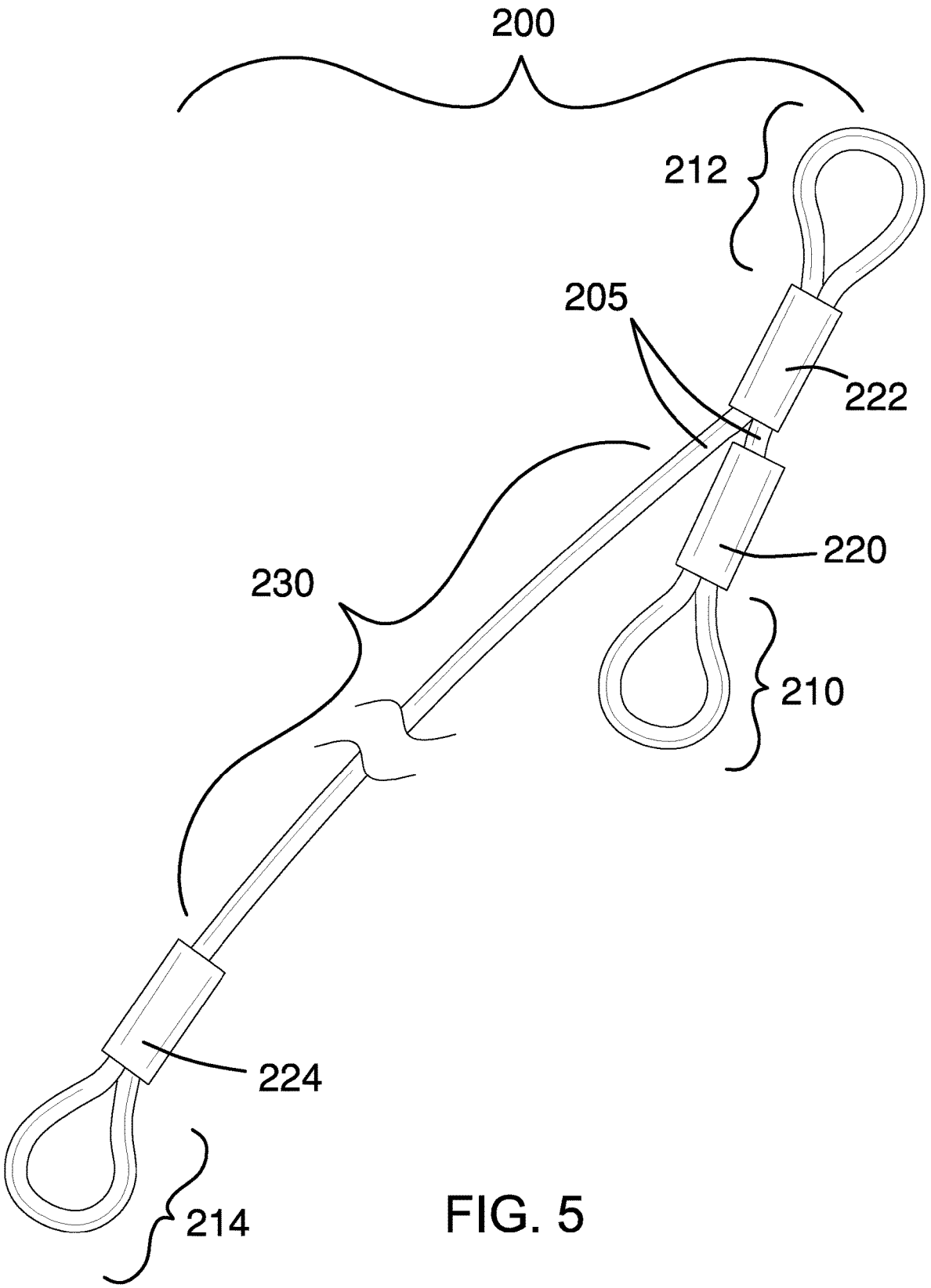
FIG. 5 is a detail view of an embodiment of the disclosure illustrating the recovery harness.

Detailed reference will now be made to a first potential embodiment of the disclosure, which is illustrated in FIGS. 1 through 5.

The anchor-retrieving system 100 (hereinafter invention) comprises a recovery harness 200 and a lap link 260. The recovery harness 200 may couple to a head 910 of an anchor 900 via the lap link 260 such that if the anchor 900 becomes fouled and the lap link 260 fails, a trip line 230 of the recovery harness 200 may be operable to recover the anchor 900 by pulling the anchor 900 from a crown 912 of the anchor 900.

A cable 205 may be a flexible, stranded metal cable or metal rope. In some embodiments, the cable 205 may be made of stainless steel. The recovery harness 200 may comprise a first loop 210, a second loop 212, and a third loop 214. The first loop 210 may be a bight of the cable 205. The first loop 210 may be formed by bending the cable 205 by 180 degrees to form the first loop 210 and by crimping a first crimp sleeve 220 onto the cable 205 on either side of the first loop 210. The second loop 212 may be a bight of the cable 205. The second loop 212 may be formed by bending the cable 205 by 180 degrees to form the second loop 212 and by crimping a second crimp sleeve 222 onto the cable 205 on either side of the second loop 212. The third loop 214 may be a bight of the cable 205. The third loop 214 may be formed by bending the cable 205 by 180 degrees to form the third loop 214 and by crimping a third crimp sleeve 224 onto the cable 205 on either side of the third loop 214. In some embodiments, the recovery harness 200 may be made using a single cable that is bent and crimped in three places to form the bights.

The first loop 210 may be adjacent to the second loop 212. The third loop 214 may be separated from the second loop 212 via the trip line 230 which is a portion of the cable 205 located between the second loop 212 and the third loop 214. The length of the trip line 230 may be at least as long as the length of a shank 916 of the anchor 900 to which the recovery harness 200 will be attached such that the trip line 230 remains slack while the anchor 900 is in use.

The first loop 210 may couple to the lap link 260. The second loop 212 may couple to rode attachment hardware 940. As non-limiting examples, the rode attachment hardware 940 may be one or more shackles, clips, swivels, rings, or combinations thereof. The rode attachment hardware 940 may in turn couple to an anchor line 950. As non-limiting examples, the anchor line 950 may be a rope or a chain. The third loop 214 may couple, either directly or indirectly, to a trip line aperture 922 in the crown 912 of the anchor 900.

The lap link 260 may be an open metal loop comprising a first end 262 and a second end 264 where the first end 262 overlaps but does not couple to the second end 264. The lap link 260 may be coupled to the head 910 of the anchor 900 via an eye 920 of the anchor 900 and to the first loop 210 of the recovery harness 200.

In some embodiments, the first end 262 of the lap link 260 and the second end 264 of the lap link 260 may be bent or otherwise moved to positions where the first end 262 is adjacent to the second end 264 once the lap link 260 is coupled to the anchor 900 and to the recovery harness 200 such that the lap link 260 is retained on the anchor 900. The lap link 260 may be operable to bend or to break when a force 290 applied to the lap link 260 by the recovery harness 200 exceeds a predetermined force threshold such that the first loop 210 of the recovery harness 200 separates from the head 910 of the anchor 900. The predetermined force threshold may be lower than the amount of force necessary to bend or break the recovery harness 200, the rode attachment hardware 940, the anchor line 950, or the anchor 900.

In use, the first loop 210 of the recovery harness 200 is coupled to the lap link 260 and the lap link 260 is coupled to the eye 920 at the head 910 of the anchor 900. The second loop 212 of the recovery harness 200 is coupled to the rode attachment hardware 940 and the rode attachment hardware 940 is coupled to the anchor line 950. The third loop 214 is coupled, either directly or indirectly, to the trip line aperture 922 at the crown 912 of the anchor 900. As non-limiting examples, if the anchor 900, the lap link 260, and the recovery harness 200 are sold as a single unit, the third crimp sleeve 224 may be crimped after the cable 205 is passed through the trip line aperture 922 to form the third loop 214. If the recovery harness 200 and the lap link 260 are sold separately from the anchor 900, the third loop 214 may be coupled to the trip line aperture 922 using a shackle, clip, ring, or other coupling hardware.

During normal use, the anchor line 950 may be fed out to drop the anchor 900 and as the anchor 900 drags across the bottom one or more flukes 914 on the anchor 900 may dig into the bottom to secure the anchor 900. To weigh anchor, an upward pull on the anchor line 950 may pull the one or more flukes 914 from the bottom so that the vessel can move.

When the anchor 900 becomes stuck, the upward pull on the anchor line 950 may fail to release the anchor 900. As non-limiting examples, the anchor 900 may become stuck if the one or more flukes 914 wedge under a rock or under a previously discarded anchor line. In these circumstances, the upward pull may be exerted on the anchor line 950 such that the pulling force exceeds the predetermined force threshold, causing the lap link 260 to bend or break such that the first loop 210 is released from the eye 920 of the anchor 900. With the first loop 210 released, continued upward pulling on the anchor line 950 may remove the slack from the trip line 230 and the cable 205 may begin pulling on the crown 912 of the anchor 900 instead of the head 910 of the anchor 900. This may cause the one or more flukes 914 to slide out from under the object that has them stuck and may release the anchor 900. The released anchor may then be weighted, the lap link 260 may be replaced, and the anchor 900 may be used again.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "anchor" is a device that holds an object in place. When used as a verb, "anchor" refers to hold an object firmly or securely.

As used in this disclosure, an "aperture" is an opening in a surface. Aperture may be synonymous with hole, slit, crack, gap, slot, or opening.

As used in this disclosure, a "bight" refers to a loop of rope, line, or cable.

As used in this disclosure, a "chain" is a series of interlinked rings that form a cord like structure. Like a cord, a chain has tensile strength but is too flexible to provide compressive strength and is not suitable for use in pushing objects. The rings to form a chain are often formed from a metal.

As used herein, the words "couple", "couples", "coupled" or "coupling", refer to connecting, either directly or indirectly, and does not necessarily imply a mechanical connection.

As used in this disclosure, "flexible" refers to an object or material which will deform when a force is applied to it, which will not return to its original shape when the deforming force is removed, and which may not retain the deformed shape caused by the deforming force.

As used herein, "lap link" refers to a non-continuous loop of material where the ends of the link overlap each other. A lap link is often made of metal and may be used to repair or extend a chain: an end of the lap link is passed through an end link of a first chain and then though an end link of a second chain then the lap link is hammered to bring the overlapping ends of the lap link together such that the first chain and second chain may not separate from the lap link.

As used in this disclosure, a "sleeve" is a tube like covering that is placed over or around a rod, shaft, cable, or other cylindrical object.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An anchor-retrieving system comprising:

a recovery harness and a lap link;

wherein the recovery harness couples to a head of an anchor via the lap link such that if the anchor becomes fouled, a trip line of the recovery harness is operable to recover the anchor by pulling the anchor from a crown of the anchor;

wherein the recovery harness is further defined as a cable;

wherein the cable is further defined with a first loop, a second loop, and a third loop;

wherein the first loop is a bight of the cable;

wherein the first loop is formed by bending the cable by 180 degrees to form the first loop and by crimping a first crimp sleeve onto the cable on either side of the first loop.

2. The anchor-retrieving system according to claim 1 Wherein the cable is stranded metal cable or metal rope.

3. The anchor-retrieving system according to claim 2 wherein the cable is made of stainless steel.

4. The anchor-retrieving system according to claim 1 wherein the second loop is a bight of the cable;

wherein the second loop is formed by bending the cable by 180 degrees to form the second loop and by crimping a second crimp sleeve onto the cable on either side of the second loop.

5. The anchor-retrieving system according to claim 4 wherein the third loop is a bight of the cable;

wherein the third loop is formed by bending the cable by 180 degrees to form the third loop and by crimping a third crimp sleeve onto the cable on either side of the third loop.

6. The anchor-retrieving system according to claim 5 wherein the first loop, the second loop, and the third loop are formed in the cable, which is bent and crimped in three places to form the bight in the first loop, the bight in the second loop, and the bight in the third loop.

7. The anchor-retrieving system according to claim 5 wherein the first loop is adjacent to the second loop.

8. The anchor-retrieving system according to claim 7 wherein the third loop is separated from the second loop via the trip line which is a portion of the cable located between the second loop and the third loop.

9. The anchor-retrieving system according to claim 8 wherein a length of the trip line is at least as long as the length of a shank of the anchor to which the recovery harness is attached such that the trip line remains slack while the anchor is in use.

10. The anchor-retrieving system according to claim 9 wherein the first loop couples to the lap link.

11. The anchor-retrieving system according to claim 10 wherein the second loop couples to a rode attachment hardware.

12. The anchor-retrieving system according to claim 11 wherein the third loop couples, either directly or indirectly, to a trip line aperture in the crown of the anchor.

13. The anchor-retrieving system according to claim 12 wherein the lap link is an open metal loop comprising a first end and a second end where the first end overlaps but does not couple to the second end.

14. The anchor-retrieving system according to claim 13 wherein the lap link is coupled to the head of the anchor via an eye of the anchor and to the first loop of the recovery harness.

15. The anchor-retrieving system according to claim 14 wherein the first end of the lap link and the second end of the lap link are bent or otherwise moved to positions where the first end is adjacent to the second end once the lap link is coupled to the anchor and to the recovery harness such that the lap link is retained on the anchor.

16. The anchor-retrieving system according to claim 15 wherein the lap link is operable to bend or to break when a force applied to the lap link by the recovery harness exceeds a predetermined force threshold such that the first loop of the recovery harness separates from the head of the anchor.

17. The anchor-retrieving system according to claim 16 wherein the predetermined force threshold is lower than the amount of force necessary to bend or break the recovery harness, the rode attachment hardware, an anchor line, or the anchor.

* * * * *